US007256546B2

(12) United States Patent
Brock et al.

(10) Patent No.: US 7,256,546 B2
(45) Date of Patent: Aug. 14, 2007

(54) METAL HALIDE LAMP CHEMISTRIES WITH MAGNESIUM AND INDIUM

(75) Inventors: Lori R. Brock, Ipswich, MA (US); Joseph A. Baglio, Andover, MA (US); Joanne Browne, Newburyport, MA (US)

(73) Assignee: Osram Sylvania Inc., Danvers, MA (US)

( * ) Notice: Subject to any disclaimer, the term of this patent is extended or adjusted under 35 U.S.C. 154(b) by 507 days.

(21) Appl. No.: 10/904,657

(22) Filed: Nov. 22, 2004

(65) Prior Publication Data

US 2006/0108930 A1 May 25, 2006

(51) Int. Cl.
*H01J 17/20* (2006.01)
*H01J 61/20* (2006.01)

(52) U.S. Cl. ..... 313/640; 313/639

(58) Field of Classification Search ..... 313/639–643
See application file for complete search history.

(56) References Cited

U.S. PATENT DOCUMENTS

| | | | | |
|---|---|---|---|---|
| 3,852,630 | A * | 12/1974 | Wesselink et al. | 313/640 |
| 5,424,609 | A | 6/1995 | Geven et al. | 313/623 |
| 5,698,948 | A | 12/1997 | Caruso | 313/637 |
| 6,069,456 | A | 5/2000 | Fromm et al. | 315/248 |
| 6,479,950 | B2 | 11/2002 | Takahashi et al. | 313/291 |
| 6,483,241 | B1 | 11/2002 | Stockwald | 313/638 |
| 6,501,220 | B1 | 12/2002 | Lambrechts et al. | 313/571 |
| 6,525,476 | B1 | 2/2003 | Geijtenbeek et al. | 313/640 |
| 6,620,272 | B2 | 9/2003 | Zaslavsky et al. | 156/73.5 |
| 6,717,364 | B1 | 4/2004 | Zhu et al. | 313/642 |
| 2002/0185973 | A1 | 12/2002 | Jackson et al. | 313/607 |
| 2004/0056599 | A1 | 3/2004 | Brock | 313/634 |
| 2004/0189212 | A1 * | 9/2004 | Ashida et al. | 315/97 |
| 2004/0217710 | A1 | 11/2004 | Zhu et al. | 313/639 |

* cited by examiner

*Primary Examiner*—Joseph Williams
*Assistant Examiner*—Bumsuk Won
(74) *Attorney, Agent, or Firm*—Robert F. Clark

(57) ABSTRACT

A metal halide fill for a discharge lamp is provided that is comprised of mercury and a mixture of metal halide salts which includes magnesium iodide as a full or partial replacement for calcium iodide. The replacement of at least some of the calcium iodide improves the behavior of the molten salt condensate in the arc tube. In particular, the mixture of metal halide salts contains about 1 to about 50 mole percent sodium iodide, about 15 to about 50 mole percent of a rare earth iodide, about 10 to about 30 mole percent magnesium iodide, about 10 to about 25 mole percent of indium iodide, and about 0 to about 25 mole percent calcium iodide, wherein the sum of the amounts of calcium iodide and magnesium iodide in the mixture is from about 20 to about 45 mole percent.

26 Claims, 2 Drawing Sheets

METAL HALIDE LAMP CHEMISTRIES WITH MAGNESIUM AND INDIUM

BACKGROUND OF THE INVENTION

This invention relates generally to metal halide fill chemistries for discharge lamps. More particularly, this invention relates to metal halide fills containing magnesium and indium.

Metal halide discharge lamps are favored for their high efficacies and high color rendering properties which result from the complex emission spectra generated by their rare-earth chemistries. Particularly desirable are ceramic metal halide lamps which offer improved color rendering, color temperature, and efficacy over traditional quartz arc tube types. This is because ceramic arc tubes can operate at higher temperatures than their quartz counterparts and are less prone to react with the various metal halide chemistries. Like most metal halide lamps, ceramic lamps are typically designed to emit white light. This requires that the x,y color coordinates of the target emission lay on or near the black-body radiator curve. Not only must the fill chemistry of the lamp be adjusted to achieve the targeted emission, but this must also be done while maintaining a high color rendering index (CRI) and high efficacy (lumens/watt, LPW).

In order to accomplish these objectives, most commercial ceramic metal halide lamps contain a complex combination of metal halides. For example, a commercial 4200 K lamp may contain mercury plus a mixture of NaI, $CaI_2$, $DyI_3$, $HoI_3$, $TmI_3$, and TlI. In general, iodide salts are more favored than fluorides because of their lower reactivity and are more favored than chlorides or bromides because they tend to be less stable at higher temperatures. Calcium iodide contributes red to the emission spectrum of the discharge to raise its R9 value and may also used to manipulate the electrical characteristics of the lamp.

SUMMARY OF THE INVENTION

The inventors have determined that the presence of calcium iodide in metal halide fills can be linked to an undesirable spread in the correlated color temperatures (CCT) of certain metal halide lamps, particularly those with bulgy-shaped arc tubes. Thus it is desirable to limit the use of calcium iodide in order to reduce the variability in lamp performance.

The present invention is a metal halide fill for a discharge lamp that includes magnesium iodide as a full or partial replacement for calcium iodide. In particular, the fill is comprised of mercury and a mixture of metal halide salts that contains about 1 to about 50 mole percent sodium iodide, about 15 to about 50 mole percent of a rare earth iodide, about 10 to about 30 mole percent magnesium iodide, about 10 to about 25 mole percent of indium iodide, and about 0 to about 25 mole percent calcium iodide, wherein the sum of the amounts of calcium iodide and magnesium iodide in the mixture is from about 20 to about 45 mole percent. In a preferred embodiment, the rare earth iodide is selected from dysprosium iodide, holmium iodide, thulium iodide, or a combination thereof. Thallium iodide may be substituted for a portion of the indium iodide in the mixture of metal halide salts. Preferably, the amount of thallium iodide in the mixture is not greater than about 6 mole percent.

In a more preferred embodiment, the mixture of metal halide salts comprises 6 to 42 mole percent sodium iodide, 15 to 22 mole percent calcium iodide, 18 to 23 mole percent magnesium iodide, 10 to 25 mole percent indium iodide, and 18 to 38 mole percent of a rare earth iodide. A particularly advantageous composition for the mixture of metal halide salts comprises about 22 mole percent sodium iodide, about 19 mole percent magnesium iodide, about 17 mole percent calcium iodide, about 16 mole percent indium iodide, and about 26 mole percent of a rare earth iodide.

Preferably, the metal halide fill according to this invention produces a lamp exhibiting a correlated color temperature in the range of about 3500K to about 4700K. Preferably, lamp exhibits a color rendering index (CRI) greater than or equal to about 85, and more preferably, greater than about 90. In addition, the metal halide fills according to this invention are highly efficacious. Lamp efficacy is preferred to be at least about 90 lumens/watt (LPW) and more preferably at least about 100 LPW.

DETAILED DESCRIPTION OF THE INVENTION

For a better understanding of the present invention, together with other and further objects, advantages and capabilities thereof, reference is made to the following disclosure and appended claims taken in conjunction with the above-described drawings.

As described above, the metal halide fills according to this invention uses magnesium iodide as a partial or full calcium iodide replacement. The replacement of at least some of the calcium iodide improves the behavior of the molten salt condensate and reduces lamp-to-lamp CCT variability. However, in order to achieve commercially desirable photometric properties, the magnesium iodide must be used together with indium iodide or a combination of indium iodide and thallium iodide.

Magnesium has a strong emission in the green region of the visible spectrum at about 518 nm which is near the green emission produced by thallium at about 535 nm. As this emission is near the peak of the human eye sensitivity curve, magnesium contributes to a high luminous efficacy of the lamp. However, magnesium and mercury also emit in the blue region of the visible spectrum between about 380 nm to about 440 nm. These blue emissions can cause a significant increase in the color temperature of the lamp.

The addition of indium or a combination of indium and thallium to the magnesium and mercury-containing fill decreases the CCT to preferred levels. This is because In and Tl atoms have broad self-reversed absorption bands in the blue region of the spectrum. The indium band is centered at about 410 nm and the thallium band at about 378 nm. These self-reversed bands absorb the blue Mg and Hg emissions but not the relatively strong green Mg emissions. Elimination of the thallium from metal halide fills has been shown to make the lamps more amenable to dimming. For example, U.S. Pat. No. 6,717,364 describes using magnesium iodide as a substitute for thallium iodide to produce a dimmable, thallium-free lamp. Therefore, it is desirable to limit the amount of thallium in metal halide fills. Preferably, the amount of thallium iodide in the mixture of metal halide salts is in the range of 0 to about 6 mole percent.

Figure 1:
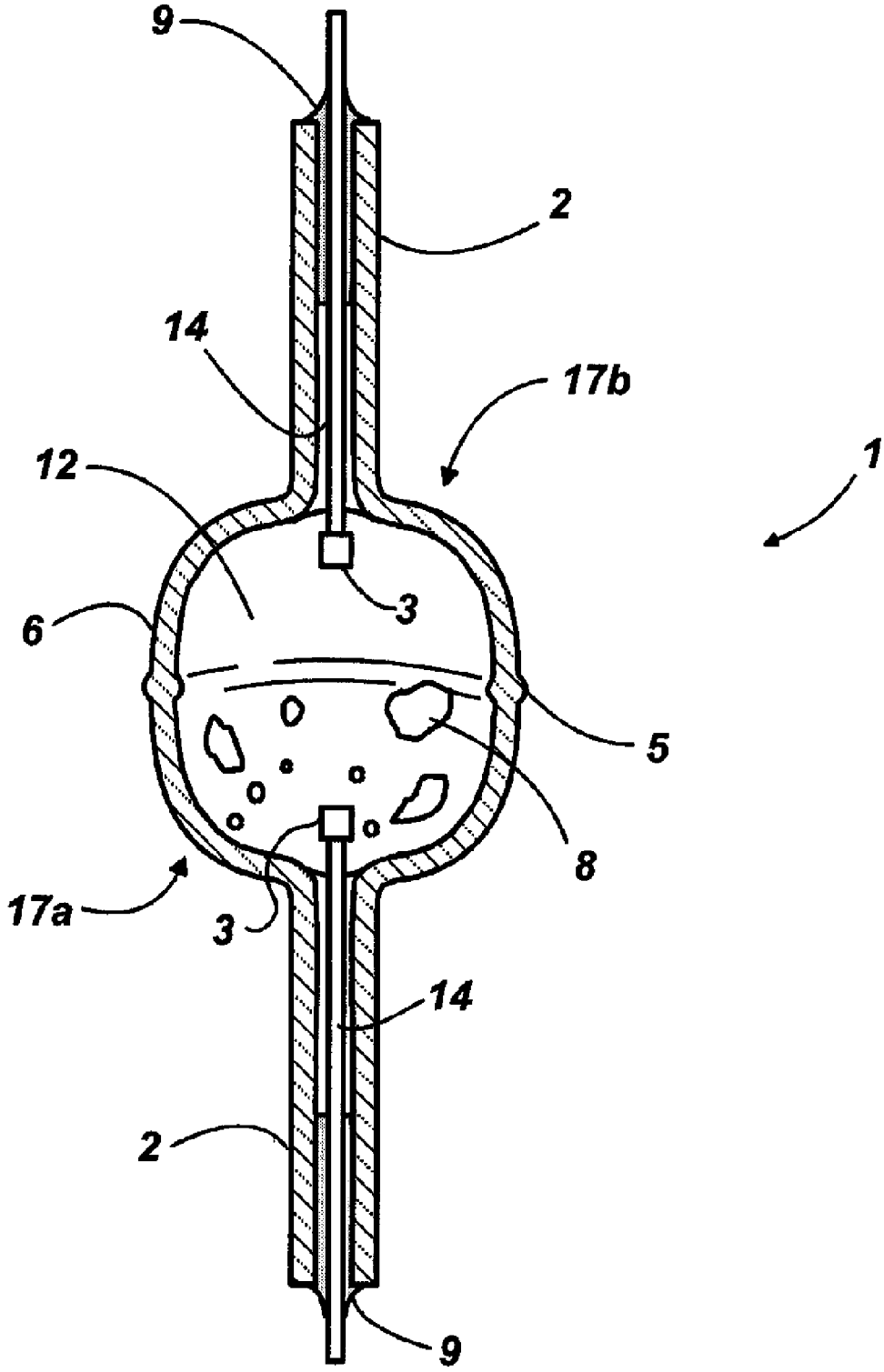
FIG. 1 is a cross-sectional illustration of a ceramic metal halide arc tube.

Referring now to FIG. 1, there is shown a cross-sectional illustration of a ceramic metal halide arc tube. The arc tube 1 is a two-piece design which is made by joining two identically molded ceramic halves in their green state and then subjecting the green piece to a high temperature sintering. The method of making the arc tube typically leaves a cosmetic seam 5 in the center of the arc tube where the two halves were mated. A more detailed description of a method of making this type of ceramic arc tube is described in U.S. Pat. No. 6,620,272 which is incorporated herein by reference. The arc tube is usually composed of translucent polycrystalline alumina, although other ceramic materials may be used.

The arc tube has hemispherical end wells 17*a*, 17*b* and is commonly referred to as a bulgy shape. The bulgy shape is preferred because it provides a more uniform temperature distribution compared to right-cylinder shapes such as those described in U.S. Pat. Nos. 5,424,609 and 6,525,476. The bulgy-shaped arc tube has an axially symmetric body 6 which encloses a discharge chamber 12. Two opposed capillary tubes 2 extend outwardly from the body 6 along a central axis. In this 2-piece design, the capillary tubes have been integrally molded with the arc tube body. The discharge chamber 12 of the arc tube contains a buffer gas, e.g., 30 to 300 torr Xe or Ar, and a metal halide fill 8 as described herein.

Electrode assemblies 14 are inserted into each capillary tube 2. One end of the electrode assemblies 14 protrudes out of the arc tube to provide an electrical connection. The tips of the electrode assemblies which extend into the discharge chamber are fitted with a tungsten coil 3 or other similar means for providing a point of attachment for the arc discharge. The electrode assemblies are sealed hermetically to the capillary tubes by a frit material 9 (preferably, a $Al_2O_3$—$SiO_2$—$Dy_2O_3$ frit). During lamp operation, the electrode assemblies act to conduct an electrical current from an external source of electrical power to the interior of the arc tube in order to form an electrical arc in the discharge chamber.

Figure 2:
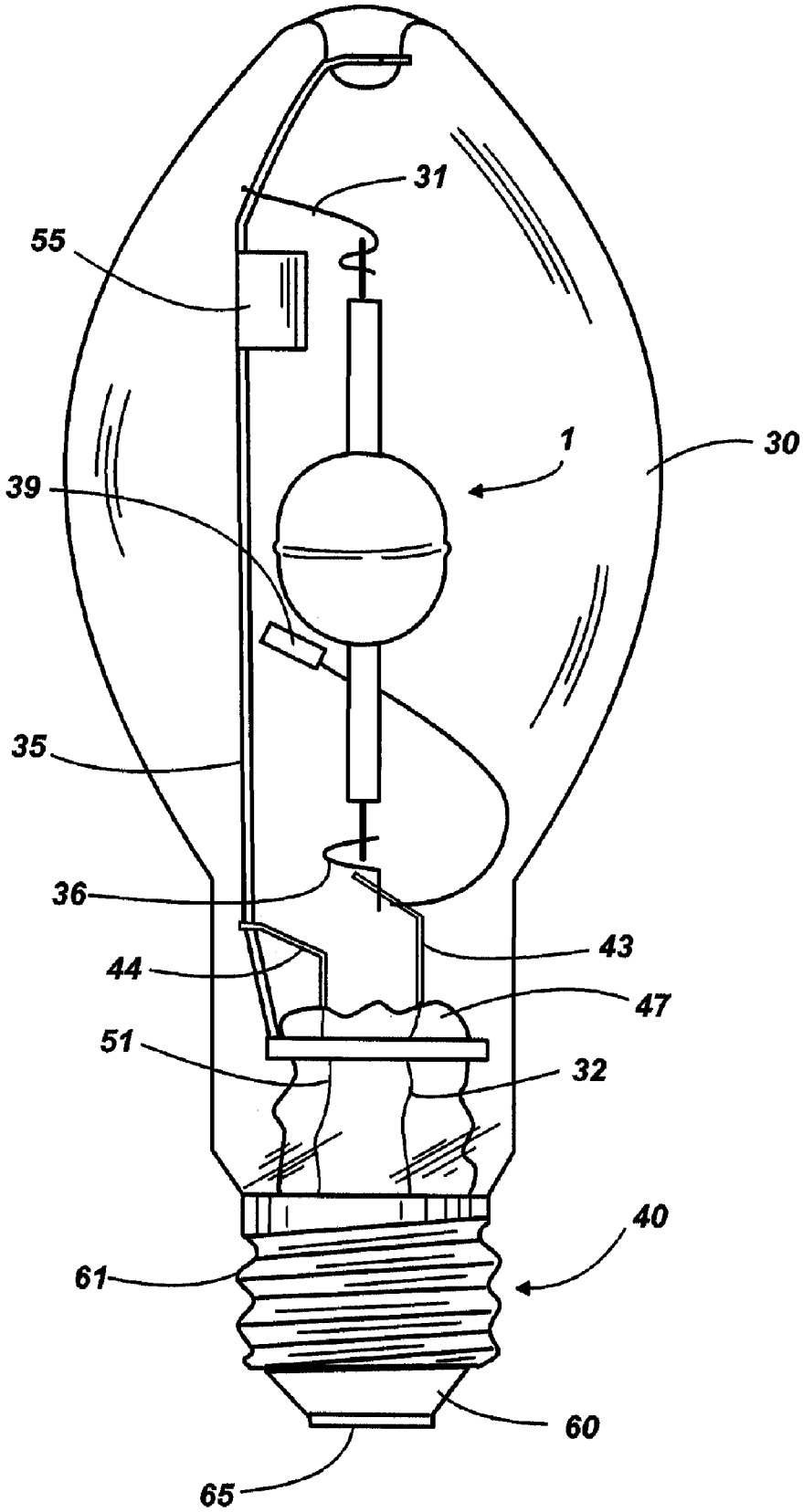
FIG. 2 is an illustration of a ceramic metal halide lamp.

FIG. 2 is an illustration of a ceramic metal halide lamp. The arc tube 1 is connected at one end to leadwire 31 which is attached to frame 35 and at the other end to leadwire 36 which is attached to mounting post 43. Electric power is supplied to the lamp through screw base 40. The threaded portion 61 of screw base 40 is electrically connected to frame 35 through leadwire 51 which is connected to a second mounting post 44. Base contact 65 of screw base 40 is electrically isolated from the threaded portion 61 by insulator 60. Leadwire 32 provides an electrical connection between the base contact 65 and the mounting post 43. A UV-generating starting aid 39 is connected to mounting post 43. Leadwires 51 and 32 pass through and are sealed within glass stem 47. A glass outer envelope 30 surrounds the arc tube and its associated components and is sealed to stem 47 to provide a gas-tight environment. Typically, the outer envelope is evacuated, although in some cases it may contain up to 400 torr of nitrogen gas. A getter strip 55 is used to reduce contamination of the envelope environment.

Six ceramic metal halide lamps were made with 250 W bulgy-shaped PCA arc tubes containing the metal halide fill according to this invention. The composition of the mixture of metal halide salts used in the fill for each lamp is given in Table 1. In addition, Lamps 1-3 contained 21 mg of mercury and Lamps 4-6 contained 24 mg of mercury. All arc tubes contained 9 mg of the mixture of metal halide salts and 90 torr Ar gas. Lamps 1-3 were made with arc tubes that were slightly smaller than the ones in Lamps 4-6, and therefore had a higher wall loading. The arc gap was 17.0 mm in Lamps 1-3 and 16.4 mm in Lamps 4-6. A vacuum outer jacket in a BT28 shape was used and the lamps were operated in a vertical, base-up orientation for 1 to 2 hours. Photometry data for the six lamps is provided in Table 2.

Two additional lamps, Lamps 7 and 8, were made with 150 W bulgy-shaped arc tubes. Each 150W lamp contained 11.4 mg Hg. Lamp 7 contained 8.6 mg of the metal halide salt mixture and Lamp 8 contained 8.0 mg of the metal halide salt mixture described in Table 1. The vacuum outer jacket for Lamps 7 and 8 had an ED17 shape and the lamps were operated in a vertical, base-up orientation for 5 hours. Photometry data for these lamps are also provided in Table 2.

TABLE 1

Metal Halide Salt Mixtures (mole percent)

| Lamp No. | NaI | $CaI_2$ | $MgI_2$ | InI | TlI | $DyI_3$ | $HoI_3$ | $TmI_3$ |
|---|---|---|---|---|---|---|---|---|
| 1 | 22.5 | 16.8 | 18.9 | 16.1 | — | 8.6 | 8.6 | 8.5 |
| 2 | 22.5 | 16.8 | 18.9 | 16.1 | — | — | — | 25.7 |
| 3 | 20.4 | 16.7 | 18.8 | 16.0 | 5.3 | 7.2 | 7.2 | 8.4 |
| 4 | 22.5 | 16.8 | 18.9 | 16.1 | — | 8.6 | 8.6 | 8.5 |
| 5 | 22.5 | 16.8 | 18.9 | 16.1 | — | — | — | 25.7 |
| 6 | 20.4 | 16.7 | 18.8 | 16.0 | 5.3 | 7.2 | 7.2 | 8.4 |
| 7 | 36.4 | — | 20.6 | 7.0 | 5.5 | — | 5.3 | 25.2 |
| 8 | 17.0 | 19.3 | 20.4 | 17.1 | — | — | — | 26.2 |

TABLE 2

Photometric Properties

| Lamp No. | LPW | x | y | CCT(K) | CRI | $D_{uv}$ |
|---|---|---|---|---|---|---|
| 1 | 110.3 | 0.389 | 0.360 | 3620 | 93 | −10.4 |
| 2 | 124.2 | 0.370 | 0.364 | 4197 | 93 | 0.2 |
| 3 | 118.9 | 0.392 | 0.370 | 3627 | 96 | −6.8 |
| 4 | 112.6 | 0.386 | 0.369 | 3777 | 95 | −5.8 |
| 5 | 131.8 | 0.373 | 0.366 | 4148 | 93 | −2.9 |
| 6 | 117.2 | 0.375 | 0.368 | 4098 | 95 | −2.5 |
| 7 | 112.4 | 0.356 | 0.371 | 4702 | 85 | 5.3 |
| 8 | 123.9 | 0.383 | 0.382 | 3968 | 91 | 1.7 |

All of the test lamps in Table 2 had a CRI of at least about 85 and most had a CRI of at least 90. The CCT of the lamps ranged from about 3600K to about 4700K and all had an efficacy of greater than about 100 LPW. Lamps 2 and 5 had the most efficacious chemistries as well as a desirable CCT of about 4200K and CIE x,y, color points on or very near the black body curve (Plankian locus). Those skilled in the art will appreciate that $D_{uv}$, the distance of the x,y color points from the Plankian locus, may be adjusted to zero by slightly altering the concentrations of the individual components in the fill, in particular, the thallium and/or sodium concentrations. Preferably, a metal halide lamp according to this invention will have a $D_{uv}$ within the range of about +5 to about −10. More preferably, the $D_{uv}$ will be in the range of about +1 to about −5, and even more preferably about +0.2 to about −2.5.

While there have been shown and described what are present considered to be the preferred embodiments of the invention, it will be apparent to those skilled in the art that various changes and modifications can be made herein without departing from the scope of the invention as defined by the appended claims.

What is claimed is:

1. A metal halide fill for a discharge lamp comprising:

mercury and a mixture of metal halide salts;

the mixture of metal halide salts comprising about 1 to about 50 mole percent sodium iodide, about 15 to about 50 mole percent of a rare earth iodide, about 10 to about 30 mole percent magnesium iodide, about 10 to about 25 mole percent of indium iodide, and about 0 to about 25 mole percent calcium iodide, wherein the sum of the amounts of calcium iodide and magnesium iodide in the mixture is from about 20 to about 45 mole percent.

2. The metal halide fill of claim 1 wherein thallium iodide is substituted for a portion of the indium iodide.

3. The metal halide fill of claim 2 wherein the rare earth iodide is selected from dysprosium iodide, holmium iodide, thulium iodide, or a combination thereof.

4. The metal halide fill of claim 2 wherein the amount of thallium iodide in the mixture is not greater than about 6 mole percent.

5. The metal halide fill of claim 1 wherein the rare earth iodide is selected from dysprosium iodide, holmium iodide, thulium iodide, or a combination thereof.

6. A metal halide fill for a discharge lamp comprising:

mercury and a mixture of metal halide salts;

the mixture of metal halide salts comprising 6 to 42 mole percent sodium iodide, 15 to 22 mole percent calcium iodide, 18 to 23 mole percent magnesium iodide, 10 to 25 mole percent indium iodide, and 18 to 38 mole percent of a rare earth iodide.

7. The metal halide fill of claim 6 wherein the mixture of metal halide salts comprises about 22 mole percent sodium iodide, about 19 mole percent magnesium iodide, about 17 mole percent calcium iodide, about 16 mole percent indium iodide, and about 26 mole percent of a rare earth iodide.

8. The metal halide fill of claim 6 wherein thallium iodide is substituted for a portion of the indium iodide.

9. The metal halide fill of claim 8 wherein the rare earth iodide is selected from dysprosium iodide, holmium iodide, thulium iodide, or a combination thereof.

10. The metal halide fill of claim 8 wherein the amount of thallium iodide in the mixture is not greater than about 6 mole percent.

11. The metal halide fill of claim 6 wherein the rare earth iodide is selected from dysprosium iodide, holmium iodide, thulium iodide, or a combination thereof.

12. A metal halide discharge lamp comprising: a base, an outer jacket, and a ceramic discharge vessel contained in the outer jacket, the ceramic discharge vessel enclosing a discharge chamber containing a metal halide fill, the discharge vessel having at least one hermetically sealed electrode assembly which extends into the discharge chamber and has an electrical connection to the base in order to generate an arc discharge within the discharge chamber;

the metal halide fill comprising:

mercury and a mixture of metal halide salts;

the mixture of metal halide salts comprising about 1 to about 50 mole percent sodium iodide, about 15 to about 50 mole percent of a rare earth iodide, about 10 to about 30 mole percent magnesium iodide, about 10 to about 25 mole percent of indium iodide, and about 0 to about 25 mole percent calcium iodide, wherein the sum of the amounts of calcium iodide and magnesium iodide in the mixture is from about 20 to about 45 mole percent.

13. The lamp of claim 12 wherein lamp exhibits a correlated color temperature in the range of about 3500K to about 4700K.

14. The lamp of claim 12 wherein the lamp exhibits a color rendering index greater than or equal to about 85.

15. The lamp of claim 12 wherein the lamp exhibits a color rendering index greater than about 90.

16. The lamp of claim 15 wherein the lamp has an efficacy of at least about 90 lumens/watt.

17. The lamp of claim 15 wherein the lamp has an efficacy of at least about 100 lumens/watt.

18. The lamp of claim 12 wherein the lamp exhibits a $D_{uv}$ within the range of about +5 to about −10.

19. The lamp of claim 12 wherein the lamp exhibits a $D_{uv}$ within the range of about +1 to about −5.

20. The lamp of claim 12 wherein the lamp exhibits a $D_{uv}$ within the range of about +0.2 to about −2.5.

21. The lamp of claim 12 wherein thallium iodide is substituted for a portion of the indium iodide.

22. The lamp of claim 21 wherein the rare earth iodide is selected from dysprosium iodide, holmium iodide, thulium iodide, or a combination thereof.

23. The lamp of claim 21 wherein the amount of thallium iodide in the mixture is not greater than about 6 mole percent.

24. The lamp of claim 12 wherein the rare earth iodide is selected from dysprosium iodide, holmium iodide, thulium iodide, or a combination thereof.

25. The lamp of claim 12 wherein the rare earth iodide is selected from dysprosium iodide, holmium iodide, thulium iodide, or a combination thereof, and the lamp exhibits a correlated color temperature in the range of about 3500K to about 4700K, a color rendering index greater than about 90, an efficacy of at least about 100 lumens/watt, and a $D_{uv}$ within the range of about +5 to about −10.

26. The lamp of claim 25 wherein thallium iodide is substituted for a portion of the indium iodide and the amount of thallium iodide in the mixture is not greater than about 6 mole percent.

* * * * *